US007082797B1

(12) United States Patent
Wiese

(10) Patent No.: US 7,082,797 B1
(45) Date of Patent: Aug. 1, 2006

(54) COILING POINT TOOL FOR SPRING COILING MACHINE, AND METHOD OF USING SAME

(76) Inventor: Thomas R. Wiese, 7901 Pinckney Rd., Pinckney, MI (US) 48169

( * ) Notice: Subject to any disclaimer, the term of this patent is extended or adjusted under 35 U.S.C. 154(b) by 188 days.

(21) Appl. No.: 10/742,101

(22) Filed: Dec. 19, 2003

(51) Int. Cl.
*B21F 3/02* (2006.01)

(52) U.S. Cl. ..... 72/140; 72/481.1; 72/481.3

(58) Field of Classification Search ..... 72/140, 72/481.1, 481.3, 141, 142, 482.93, 482.94, 72/482.1; 407/83, 89, 103; 140/124; 403/361, 403/362, 354
See application file for complete search history.

(56) References Cited

U.S. PATENT DOCUMENTS 4,393,678 A 7/1983 Favot et al.
4,520,644 A 6/1985 Lampietti
5,201,208 A * 4/1993 Jacobson ..... 72/140
5,259,226 A 11/1993 Itaya
5,259,227 A 11/1993 Jacobson
5,647,240 A 7/1997 Jacobson
5,706,687 A 1/1998 Welsh et al.
5,730,017 A 3/1998 Jacobson
5,778,746 A 7/1998 Keller et al.
6,374,655 B1 4/2002 Hresc

* cited by examiner

*Primary Examiner*—Derris H. Banks
*Assistant Examiner*—Debra M Wolfe
(74) *Attorney, Agent, or Firm*—Carrier, Blackman & Associates, P.C.; William D. Blackman; Joseph P. Carrier

(57) ABSTRACT

An indexable spring coiling point tool, for use on spring coiling machines, includes a holder for mounting in a spring-forming station of a spring coiling machine. The holder has a base end and a working end configured to engagingly receive a coiling point. The tool also includes a coiling point configured for attachment to the working end of the holder. The coiling point is formed of a material comprising a metal carbide, and is removably attachable to the working end of the holder. The coiling point can take the form of an insert or another attachment which can be removably affixed to the working end of the holder.

14 Claims, 4 Drawing Sheets

PRIOR
ART

PRIOR
ART

PRIOR
ART

FIG 8
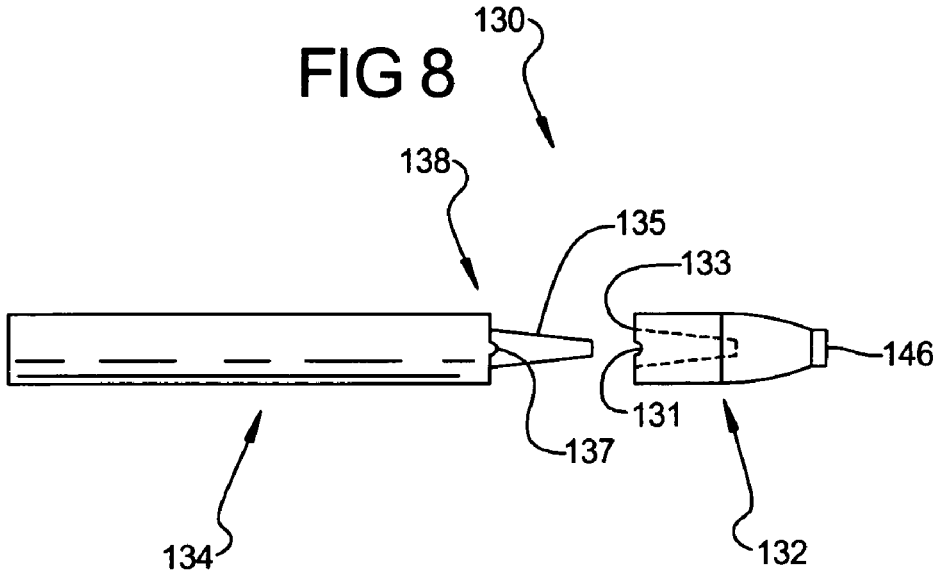
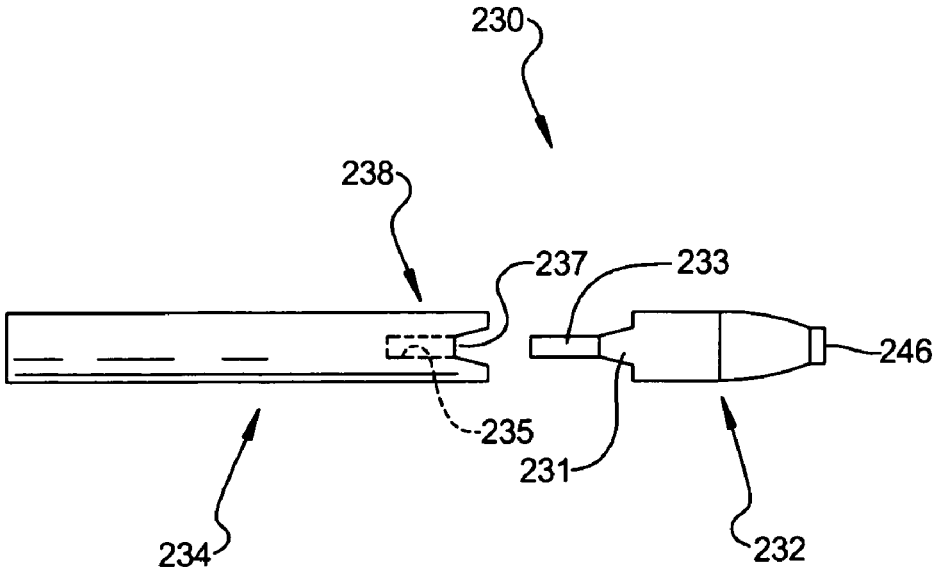
FIG 9

COILING POINT TOOL FOR SPRING COILING MACHINE, AND METHOD OF USING SAME

BACKGROUND OF THE INVENTION

1. Field of the Invention

The present invention relates to spring coiling machines, to wire shaping tools for use in spring coiling machines, and to methods of using such tools. More particularly, the present invention relates to a coiling point tool, for use in a spring coiling machine, including a holder and a replaceable coiling point which removably fits in the holder. The present invention also relates to methods of using the described tool.

2. Description of the Background Art

Many designs for spring coiling machines are known. Spring coiling machines convert metal wire from a bulk spool into individual springs. One method of turning wire into a spring in a spring coiling machine involves forcibly moving wire towards a metalworking tool, which causes the wire to bend spirally around a central mandrel. The mandrel acts counter to the force applied to the wire, and sets the diameter of the spring coil. The coiled spring is then heat-tempered to retain its form after being processed by the spring coiling machine.

A number of different devices provide for holding spring coiling tools. Examples of some of the known devices include U.S. Pat. No. 4,393,678 to Favot et al, U.S. Pat. No. 5,201,208 to Jacobson, U.S. Pat. No. 5,647,240 to Jacobson, and U.S. Pat. No. 5,706,687 to Welsh et al.

Current spring coiling metalworking tools suffer from certain drawbacks and limitations, however. The current spring coiling machines use tungsten carbide coiling point tools that are about two inches long. These tools can only be used for a limited amount of time, and then must be replaced in order to maintain the desired coil spring output.

A prior art coiling point tool of this general type is shown at 20 in FIGS. 1–3 of the drawings.

Referring now to FIGS. 1–3, known coiling point tools 20 of the type depicted are generally formed in the shape of a cylindrical rod, with a base 22 at one end of the tool for mounting in a clamp of a spring coiling tool, and a working tip 24 at the end opposite the base.

The only portion of this known tool 20 that actually contacts the feed wire is the working tip 24 thereof. The tip 24 of the tool 20 has a flattened end face 26 on the terminal end thereof, with a wire guide groove 28 formed in the end face 26, as shown, to guide movement of the feed wire therepast. It will be understood, therefore, that making the entire tool 20 from tungsten carbide is inefficient.

The removal and replacement of spring coiling point tools is laborious and time-consuming, and is therefore a relatively expensive activity. In order for an operator to safely remove worn coiling point tools and replace them with a new set, the equipment must be deactivated and production halted. Once the tools have been removed, the operator is required to setup the machine again. This is necessary because the prior setup must be reproduced with precision and accuracy, to insure uniform spring output. If an error is made in the new setup, the spring coiling tool will not work effectively, which can be expensive and inefficient.

Since the prior art tip and base are integrated in a unitary component, as shown in FIG. 1, removal of the working tip necessarily requires removal of the entire tool. The combination therefore includes wasted carbide material, since the integrated base is also disposed of when the tip is worn out or output is adversely affected. No recycling or conservation of used spring-forming tools is currently practiced.

Several spring coiling machines are illustrated in U.S. Pat. Nos. 4,393,678, 5,201,208, 5,647,240, and 5,706,687, featuring tool holders for currently utilized spring coiling tools. These inventions only teach mounting traditional spring coiling tools, but none resolve problem of the single use, non-replaceable metalworking tool.

While the aforementioned inventions provide for spring coiling tools, pins or points, a need still exists for an effective, simple mechanism for replacing the wire-contacting tip of the point tool without the need for a complete change of the entire tool.

SUMMARY OF THE INVENTION

The present invention provides an improved coiling point tool for use in a spring coiling machine. A coiling point tool according to a first embodiment of the present invention includes a holder, and a replaceable coiling point, which is attachable to the holder in an aligned configuration thereof.

The tool hereof allows the machine setup to remain substantially undisturbed, while also allowing a quick and simple removal and replacement of the coiling point. Also, the holder portion of the present invention is designed to accept a variety of standardized carbide inserts, thereby lowering operational costs. By allowing the cutting tool holder to remain in the exact location desired, the machine operator can simply replace the coiling point, at the tip portion thereof, and then resume operation. Since the entire tool has not been removed, the operator can then simply resume material flow and continue making springs with confidence in the continuity of the desired product.

Further, since tungsten carbide cutting tools are widely available for a variety of uses in metalworking, a spring coiling machine operator may be able to use or adapt carbide tips that could also be used on other types of metalworking equipment. Thus, an operator can realize cost savings by purchasing a larger supply of relatively small carbide inserts, instead of buying traditional integral spring coiling tools.

A spring coiling point tool, in accordance with a first embodiment of the present invention, includes a holder having a machined recess formed therein for nestingly receiving a carbide coiling point insert. The coiling point tool according to the first embodiment also includes a carbide coiling point insert for placement in the holder recess. The recess is configured to position the insert in a manner such that it will engage the feed wire as a traditional spring coiling point would engage the feed wire. In the tool according to the first embodiment, the holder geometry allows for easy installation of the insert, via a single screw, while the holder remains secured to the spring coiling machine, allowing for rapid and easy installation and replacement of the coiling point, as required by the operator.

Additionally, in the first embodiment hereof, the holder has a threaded hole formed therethrough to receive a threaded fastener. The hole in the holder is designed to align with a through hole provided in the coiling point insert, in order to allow a user to secure the insert in the holder cavity. A fastener, such as a small diameter machine screw is used to join the insert to the holder.

In this first embodiment, the coiling point of the tool includes a tip which extends outwardly beyond the working end of the holder, when the coiling point is attached to the holder.

Accordingly, it is an object of the present invention, in a first embodiment thereof, to provide an indexable coiling point tool in which a coiling point at the tip of the tool may be replaced without requiring replacement of the entire tool.

It is an advantage of the present invention that the tool hereof is usable in standard, commercially available spring coiling machines. The diameter of the holder is identical to the diameter of the current spring coiling points, as shown in the prior art. Therefore, users do not have to modify their machines to utilize the present invention.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 8 is an exploded plan view of a coiling point tool according to a second illustrative embodiment of the present invention; and FIG. 9 is an exploded plan view of a coiling point tool according to a third illustrative embodiment of the present invention.

DETAILED DESCRIPTION OF THE INVENTION

The present invention provides an indexable spring coiling point tool for use in a spring coiling machine. An indexable spring coiling point tool, according to one embodiment of the invention, includes a carbide coiling point and a substantially rod-shaped holder which removably holds the coiling point. The coiling point is formed from a material containing a metal carbide. Although tungsten carbide is the most commonly used metal carbide, those skilled in the relevant art will realize that other metal carbides could be used and would be suitable.

Figure 1:
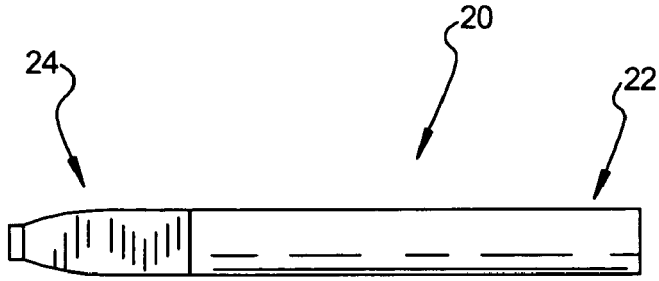
FIG. 1 is a top plan view of a prior art coiling point insert for a spring coiling machine.
Figure 2:
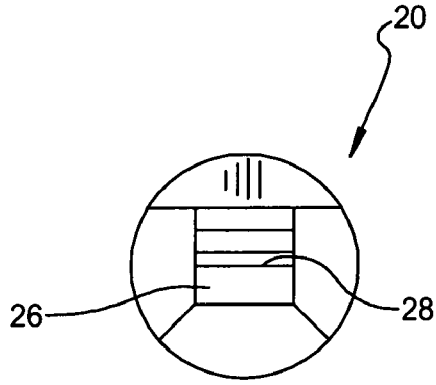
FIG. 2 is a plan view of the working tip end of the insert of FIG. 1.
Figure 3:
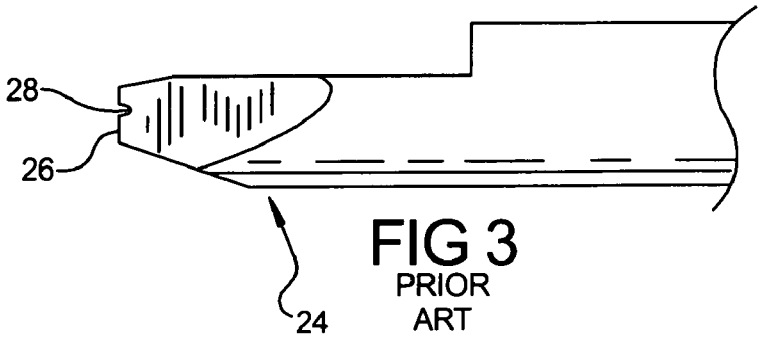
FIG. 3 is a side plan view, partially cut away, of the insert of FIG. 1.
Figure 4:
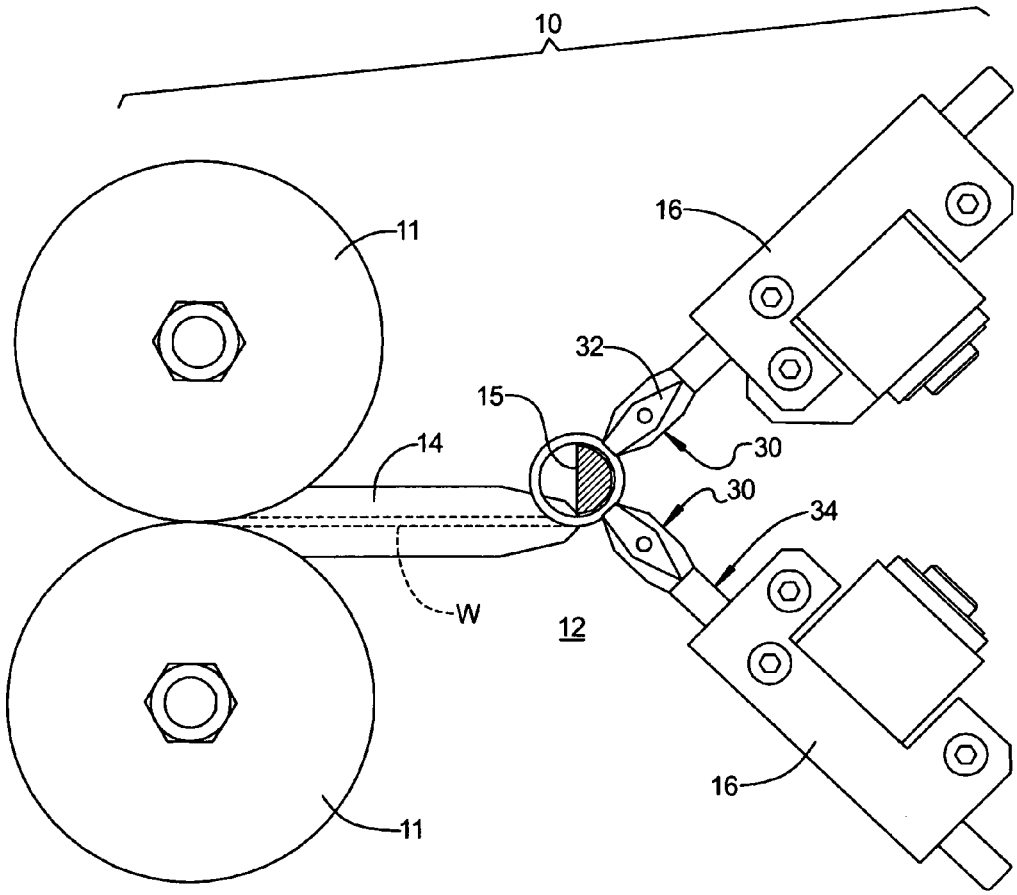
FIG. 4 is a side elevational view of a spring coiling station in a spring coiling machine, showing two point tools according to a first embodiment of the present invention installed therein.

Referring now to FIG. 4, a spring coiling machine 10 is shown, for which the spring coiling point tool 30 hereof is adapted. It should be understood that the present invention can be applied for use with other types of spring coiling machines than that shown in FIG. 4. The spring coiling machine 10 may be any one of a number of commercially available machines.

The spring coiling machine 10 includes a variety of pulleys, levers, gears, motors, switches and related components, whose primary purpose is to pull and feed a length of feed wire W from a spool, and to form the wire into individual coil springs at a spring coiling station 12. The wire W is formed into coil springs, having a variety of selectable characteristics and dimensions, at the spring coiling station 12. At a given point, the feed wire W is cut so that an individual spring is separated therefrom. The spring coiling machine 10 may be fed the same type of wire W continually over a period of time, to produce a consistent product.

The coiling station 12 acts on the wire W substantially continuously during operation thereof. The wire W is fed to the station 12 by a set of rolls 11 through a wire feed guide 14. The wire W then contacts a plurality of spring coiling point tools 30, which then bend the wire and force it into a coil shape. Another tool is used to set the pitch of the spring coil. The wire is coiled around a mandrel 15, which offers resistance to the forces applied to the wire by the coiling point tools 30. The wire W continues to be fed by the rolls 11 until a desired length of spring is produced, whereupon the spring is cut off of the feed wire by a cutting tool (not shown).

The coiling point tool 30 includes a removable and replaceable coiling point 32, at the working tip thereof. The coiling point 32 is made of hardened materials, such that the wire W yields and bends before the coiling point experiences any deflection or deformation. A preferred material for the coiling point 32 is a material comprising tungsten carbide. In the practice of the present invention, the coiling point 32 is made removable and replaceable without the necessity of removing a holder 34.

The coiling point tools 30 are secured to the spring coiling machine 10 by respective tool clamps 16, which allow for linear and angular adjustment of the tool 30, so that desired engagement with the wire W is obtained.

Figure 5:
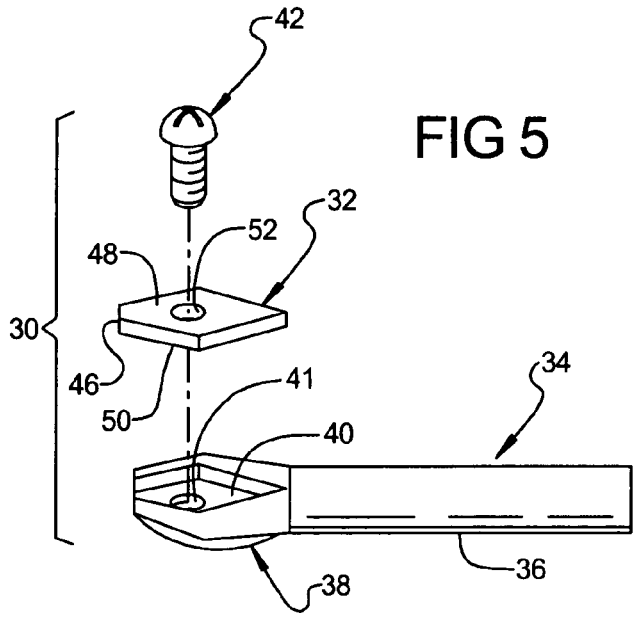
FIG. 5 is an exploded perspective view of a coiling point tool according to a first illustrative embodiment of the invention.

Referring now to FIG. 5, a coiling point tool 30 according to a first embodiment of the invention is shown in exploded perspective view, isolated from the spring machine 10. In this first embodiment, the tool 30 includes a generally rod-shaped holder having a base end 36 and a working end 38 configured to engagingly receive a coiling point 32 therein. As used herein, the term "rod-shaped" does not limit the cross-sectional shape of the rod, which may have any desired cross-sectional shape.

The tool 30 is provided with a recessed space 40 formed in the working end of the holder 34, so as to nestingly receive the coiling point 32 therein. The holder 34 has a threaded hole 41 formed therethrough, approximately in the center of the recessed space 40, to receive a threaded fastener such a screw 42 therein, to removably retain the coiling point 32 in place in the holder 34.

Removal of the screw 42 also enables the coiling point to be changed without removing the holder 34 from alignment with the machine 10. Therefore, the overall equipment setup is maintained, enhancing accuracy, consistency, and reducing machinery downtime as well.

The coiling point 32 has a substantially diamond-shaped outline in the embodiment of FIG. 5, with one end thereof truncated to provide a flattened working surface 46. Other shapes may be used for the coiling point, although it should include a flattened working surface on the tip end thereof. The coiling point 32 has substantially flattened upper and lower surfaces 48, 50, and has a hole 52 formed centrally therethrough between the upper and lower surfaces.

Figure 6:
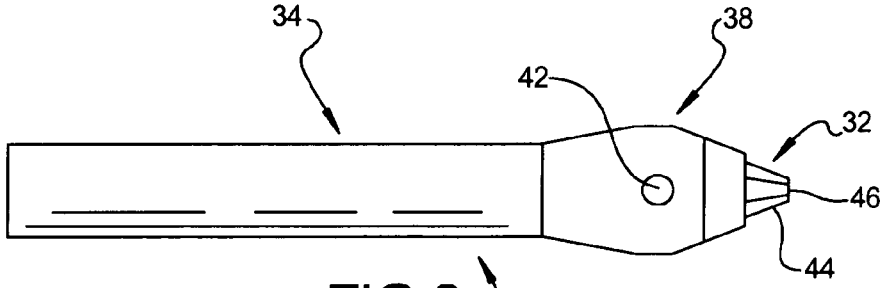
FIG. 6 is a bottom plan view of the coiling point tool of FIG. 5.

FIG. 6 shows the reverse side of the tool 30, showing the coiling point 32 extending outwardly from the working end of the holder 34, and the tip of the screw 42 extending outwardly from the bottom of the holder. It will be noted from FIG. 6 that the coiling point 32 includes a working tip 44 which extends outwardly beyond the working end 38 of the holder 34, when the coiling point is attached to the holder.

Figure 7:
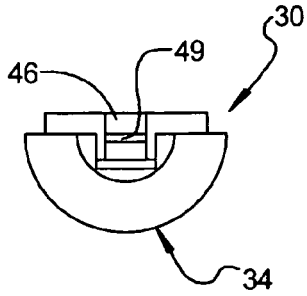
FIG. 7 is an end plan view of the coiling point tool of FIGS. 5–6, showing the structure of a working tip portion thereof.

Referring now to FIG. 7, it will be seen that the coiling point 32 extends beyond a machined surface of the holder 34, and includes a flattened end face 46 having a wire guide groove 49 formed therein.

Referring now to FIG. 8, a coiling point tool, according to a second embodiment of the present invention, is shown generally at 130. The coiling point tool 130 includes a generally rod-shaped holder 134, and a removable coiling point 132 that fits on a working end 138 of the holder. The working end 138 of the holder 134 has a protrusion 135 extending outwardly thereon, and the coiling point 132 has a correspondingly-shaped hollow recess 133 formed therein which receives the protrusion 135 therein, to join the coiling point 132 and the holder 134 together. The holder 134 has indexing structure in the form of a tab 137 on the working end 138 thereof, and the coiling point 132 has corresponding indexing structure in the form of a slot 131 thereon, so that the coiling point 132 must be aligned with the holder 134 before it can be installed thereon. This assists a user of the spring forming tool 10 in quickly attaining the correct orientation of the working surface 146 of a replacement coiling point 132.

Referring now to FIG. 9, a coiling point tool, according to a third embodiment of the present invention, is shown generally at 230. The coiling point tool 230 includes a generally rod-shaped holder 234, and a removable coiling point 232 that fits on a working end 238 of the holder. The working end 238 of the holder 234 has a hollow recess 235 formed in the end thereof, and the coiling point 232 has a correspondingly-shaped protrusion 233 extending outwardly thereon, which fits engagingly into the recess 235 of the holder 234, to join the coiling point 232 and the holder 234 together. The holder 234 has indexing structure in the form of a slot 237 on the working end 238 thereof, and the coiling point 232 has corresponding indexing structure in the form of a tab 231 thereon, so that the coiling point 232 must be aligned with the holder 234 before it can be installed thereon. This assists a user of the spring forming machine 10 in quickly and correctly orienting the working surface 246 of a replacement coiling point 232.

METHOD

The present invention also contemplates a method of using the described coiling point tool on a spring machine. A method according to an embodiment of the present invention includes a first step of attaching a coiling point tool to a spring coiling machine, in which the coiling point tool is the tool described herein.

The method also includes a step of processing wire in the spring coiling machine to form springs until the coiling point of the tool becomes worn.

The method also includes a step of removing the worn coiling point from the holder and replacing it with a new coiling point without removing the holder from said coiling machine, whereby the orientation of the holder with respect to the spring coiling machine is maintained.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having thus, described the invention, what is claimed is:

1. A coiling point tool for use in a spring coiling machine, said tool comprising:
   - a holder for mounting in a spring-forming station of a spring coiling machine, said holder comprising a rod having a base end and a working end configured to engagingly receive a coiling point; and
   - a coiling point configured for attachment to said working end of said holder, said coiling point being removably attachable to said working end of said holder, and being formed of a material comprising a metal carbide;
   - wherein said coiling point has substantially flattened upper and lower faces, and has a hole formed centrally therethrough between said upper and lower faces.

2. The coiling point tool as defined in claim 1, further comprising a fastener for removably attaching said coiling point to said holder.

3. The coiling point tool as defined in claim 1, wherein the coiling point comprises a tip which extends outwardly beyond said working end of said holder when said coiling point is attached to said holder.

4. The coiling point tool as defined in claim 1, wherein said holder has a recessed cavity formed therein for nestingly receiving said coiling point.

5. A coiling point tool for use in a spring coiling machine, said tool comprising:
   - a holder for mounting in a spring-forming station of a spring coiling machine, said holder comprising a rod having a base end and a working end configured to engagingly receive a coiling point; and
   - a coiling point configured for attachment to said working end of said holder, said coiling point being removably attachable to said working end of said holder, and being formed of a material comprising a metal carbide, wherein the working end of the holder has a hollow recess formed therein, and wherein the coiling point has a protrusion extending outwardly thereon which fits into the holder recess.

6. The coiling point tool of claim 5, wherein said holder comprises indexing structure on the working end thereof, and wherein said coiling point comprises corresponding indexing structure, so that the coiling point must be aligned with the holder before it can be installed thereon.

7. A coiling point tool for use in a spring coiling machine, said tool comprising:
   - a holder for mounting in a spring-forming station of a spring coiling machine, said holder comprising a rod having a base end and a working end configured to engagingly receive a coiling point, said working end having a recessed cavity formed therein for nestingly receiving said coiling point, and a threaded hole formed therethrough in the area of the recessed cavity to receive a fastener;
   - a coiling point configured for attachment to said working end of said holder, said coiling point being formed of a second metal comprising a carbide;
   - wherein said coiling point is configured to fit nestingly in the recessed cavity of the holder, and further wherein said coiling point has substantially flattened upper and lower surfaces, and also has a hole formed centrally therethrough between said upper and lower surfaces; and
   - a fastener for removably attaching said coiling point to said holder.

8. The coiling point tool as defined in claim 7, wherein the coiling point comprises a tip which extends outwardly beyond said working end of said holder when said coiling point is attached to said holder.

9. The coiling point tool of claim 8, wherein said tip of said coiling point comprises a work surface having a wire guide groove formed therein.

10. A coiling point tool for use in a spring coiling machine, said tool comprising:

a holder for mounting in a spring-forming station of a spring coiling machine, said holder comprising a rod having a base end and a working end configured to engagingly receive a coiling point; and a coiling point configured for attachment to said working end of said holder, said coiling point being removably attachable to said working end of said holder, and being formed of a material comprising a metal carbide;

wherein the working end of the holder has a protrusion extending outwardly thereon, and wherein the coiling point has a hollow recess formed therein which receives the protrusion.

11. The coiling point tool of claim 10, wherein said holder comprises indexing structure on the working end thereof, and wherein said coiling point comprises corresponding indexing structure, so that the coiling point must be aligned with the holder before it can be installed thereon.

12. A coiling point tool for use in a spring coiling machine, said tool comprising:

a holder for mounting in a spring-forming station of a spring coiling machine, said holder comprising a rod having a base end and a working end configured to engagingly receive a coiling point; and a coiling point configured for attachment to said working end of said holder, said coiling point being removably attachable to said working end of said holder, and being formed of a material comprising a metal carbide;

wherein said holder comprises indexing structure on the working end thereof, and wherein said coiling point comprises corresponding indexing structure so that the coiling point must be aligned with the holder before it can be installed thereon.

13. A method of using a coiling point tool, comprising the steps of:

a) attaching a coiling point tool to a spring coiling machine, said coiling point tool comprising the tool of claim 1;

b) processing wire in said spring coiling machine to form springs until said coiling point becomes worn; and c) removing said worn coiling point from said holder and replacing it with a new coiling point without removing said holder from said coiling machine, whereby the orientation of said holder with respect to said spring coiling machine is maintained.

14. The method of claim 13, wherein said coiling point is connected to said holder with a threaded fastener, and is removed from said holder by unscrewing and removing said threaded fastener.

* * * * *